US007877052B2

(12) United States Patent
Matsumoto

(10) Patent No.: US 7,877,052 B2
(45) Date of Patent: Jan. 25, 2011

(54) IMAGE FORMING APPARATUS INCLUDING DEVELOPER HAVING TWO DIFFERENT KINDS OF RESINS

(75) Inventor: Hayato Matsumoto, Tokyo (JP)

(73) Assignee: Oki Data Corporation, Tokyo (JP)

( * ) Notice: Subject to any disclaimer, the term of this patent is extended or adjusted under 35 U.S.C. 154(b) by 48 days.

(21) Appl. No.: 12/394,098

(22) Filed: Feb. 27, 2009

(65) Prior Publication Data

US 2009/0226226 A1 Sep. 10, 2009

(30) Foreign Application Priority Data

Mar. 7, 2008 (JP) ..... 2008-058551
Feb. 19, 2009 (JP) ..... 2009-036462

(51) Int. Cl.
*G03G 15/20* (2006.01)

(52) U.S. Cl. ..... 399/328; 430/109.4

(58) Field of Classification Search ..... 399/24, 399/27, 320, 328, 329; 430/109.4, 110.3, 430/110.4, 111.4
See application file for complete search history.

(56) References Cited

U.S. PATENT DOCUMENTS 6,472,117 B1 * 10/2002 Kohyama et al. ..... 430/110.3
6,537,716 B1 3/2003 Doi et al.
7,625,684 B2 * 12/2009 Kamiyoshi et al. ..... 430/109.4
2006/0204880 A1 9/2006 Mizutani et al.
2008/0268365 A1 * 10/2008 Yamazaki et al. ..... 430/109.4

FOREIGN PATENT DOCUMENTS

JP 2003-246920 A 9/2003
JP 2004-264803 A 9/2004
JP 2005-077928 A 3/2005
JP 2005-181848 A 7/2005
JP 2006-047332 A 2/2006
JP 2007-193099 A 8/2007
JP 2007-233021 A 9/2007
JP 2008015244 A 1/2008
JP 2008015333 A 1/2008

OTHER PUBLICATIONS

European Search Report for EP Application No. 09153961.9, date of mailing: May 6, 2010, 7 pages.

* cited by examiner

*Primary Examiner*—Hoan Tran
(74) *Attorney, Agent, or Firm*—Panitch Schwarze Belisario & Nadel LLP

(57) ABSTRACT

In the image forming apparatus, an image forming section forms an image onto medium by using developer; and a fixing section has a fixing member which fixes the image onto medium at a predetermined temperature and has a pressing member which is in contact with and presses the fixing member by a predetermined pressure amount, and fixes the image formed by the image forming section onto the medium while conveying the medium at a predetermined speed, wherein the developer contains binder including crystalline resin and amorphous resin, and the endothermic peak temperature difference between crystalline resin and amorphous resin is from 3° C. to 9° C.

17 Claims, 6 Drawing Sheets

IMAGE FORMING APPARATUS INCLUDING DEVELOPER HAVING TWO DIFFERENT KINDS OF RESINS

FIELD OF THE INVENTION

The invention relates to an image forming apparatus.

BACKGROUND OF THE INVENTION

In order to achieve high-speed full-color image printing, recent years, many image forming apparatuses use developer with low-molecular resin serving as binder and varieties of releasing agents of different melting points. Image forming apparatuses using this kind of developer can provide a good temperature range during the fixing process. It may refer to Patent Document 1.

Patent Document 1: Japan patent publication of No. 2006-47332.

However, in such case, the developer with low-molecular resin serving as binder will be fused when preserved. This is the so-called blocking phenomenon. In addition, in order to prevent the blocking phenomenon, high-molecular resin is used as binder. This may narrow the temperature range under the low-temperature conditions during the fixing process.

SUMMARY OF THE INVENTION

A first aspect of the invention is to provide an image forming apparatus, the image forming apparatus comprises an image forming section that forms an image onto medium by using developer; and a fixing section that has a fixing member which fixes the image onto medium at a predetermined temperature and has a pressing member which is in contact with and presses the fixing member by a predetermined pressure amount, and that fixes the image formed by the image forming section onto the medium while conveying the medium at a predetermined speed, wherein the developer contains binder including crystalline resin and amorphous resin, and the endothermic peak temperature difference between crystalline resin and amorphous resin is from 3° C. to 9° C.

A second aspect is to further provide an image forming apparatus, the image forming apparatus comprises an image forming section that forms image onto medium by using developer; and a fixing section that has a fixing member which fixes the image onto medium at a predetermined temperature and has a pressing member which is in contact with and presses the fixing member by a predetermined amount of pressure, and that fixes the image formed by the image forming section onto the medium while conveying the medium at a predetermined speed, wherein the developer contains two kinds of resin with different endothermic peak temperature when the endothermic peak temperature of the developer is from 55° C. to 80° C.; the endothermic peak temperature difference between the resins is from 3° C. to 9° C.

Effect of the Invention

According to the image forming apparatus of the invention, it can provide a good temperature range under the low-temperature conditions during the fixing process and can provide good preserving condition for the developer.

The above and other objects and features of the present invention will become apparent from the following detailed description and the appended claims with reference to the accompanying drawings.

DETAILED DESCRIPTION OF THE PREFERRED EMBODIMENTS

Embodiments of the invention will be described in detail hereinbelow with reference to the drawings. Here, it is to explain the main structure of the image forming apparatus, the image forming process and the developer used in the image forming apparatus.

Embodiment 1

Figure 1:
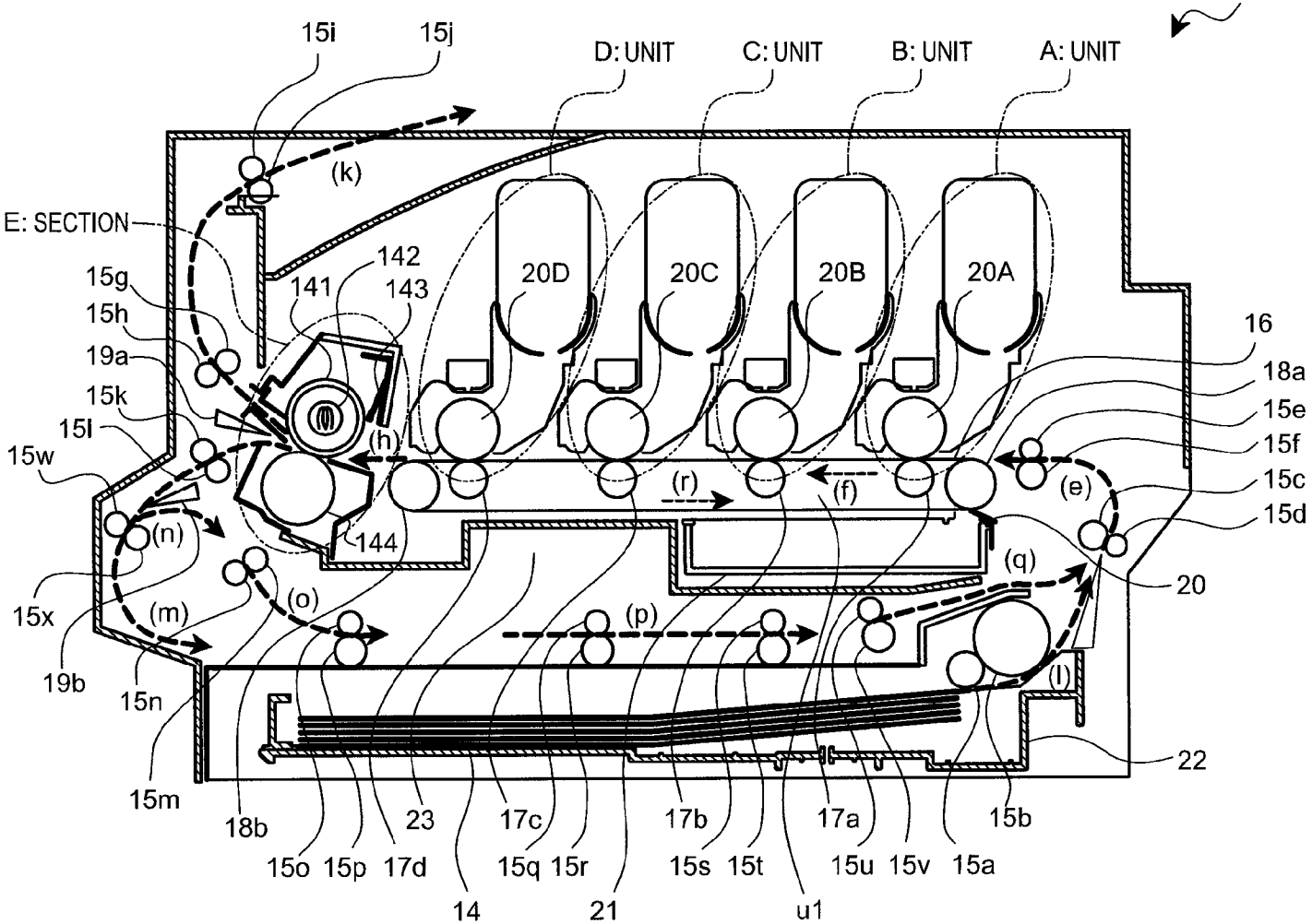
FIG. 1 is a diagram showing a main structure of the image forming apparatus.

FIG. 1 is a diagram showing a summary structure of the image forming apparatus of the present invention.

A printer 100 is a color electronic photo printer, which includes paper feeding mechanism cassette 22, image forming units A~D, transfer unit u1 and fixing section E.

Further, the printer 100 comprises conveying rollers 15*c*~15*f* and 15*h*~15*x* that convey paper 14 to the sections above, removable paper guides 19*a* and 19*b*.

Removable paper feeding mechanism cassette 22 contains stacked paper 14 and is installed in the lower part of printer 100. Paper feeding rollers 15*a* and 15*b* convey paper 14 in paper feeding mechanism cassette 22 from the top page along a direction of an arrow I as shown by FIG. 1. Conveying rollers 15*c*, 15*d*, 15*e* and 15*f* corrects the obliquity of paper 14 while conveying it to image forming units A~D along a direction of an arrow e as shown by FIG. 1.

Image forming section includes four removable image forming units A~D on the conveying route and transfer unit u1 that transfers the developing image formed by the image forming units A~D to paper 14 by Coulomb force. Furthermore, the structures of image forming units A~D are exactly the same. Only the color of the developer inside, that is yellow, magenta, cyan and black, is different.

Transfer unit u1 includes non-joint transfer belt 16 that conveys the paper by electrostatic adsorption, driving roller 18*b* rotated by a driving section (not shown) that drives transfer belt 16, idle belt roller 18*a* that couples with driving roller 18*b* and stretches transfer belt 16, transfer rollers 17*a*~17*d* comprising image forming units A~D that are connected with photosensitive drums 20A~20D (described below) and transfer the developing image formed on photosensitive drums 20A~20D to paper 14 by external voltage, cleaning blade 20 that scratches the developer attached on transfer belt 16 and cleans transfer belt 16, discarded developer accommodating tank 21 that accommodates the developer recycled by cleaning blade 20. Image forming section transfers different developing images to paper 14 along a direction of an arrow f as shown by FIG. 1.

Figure 2:
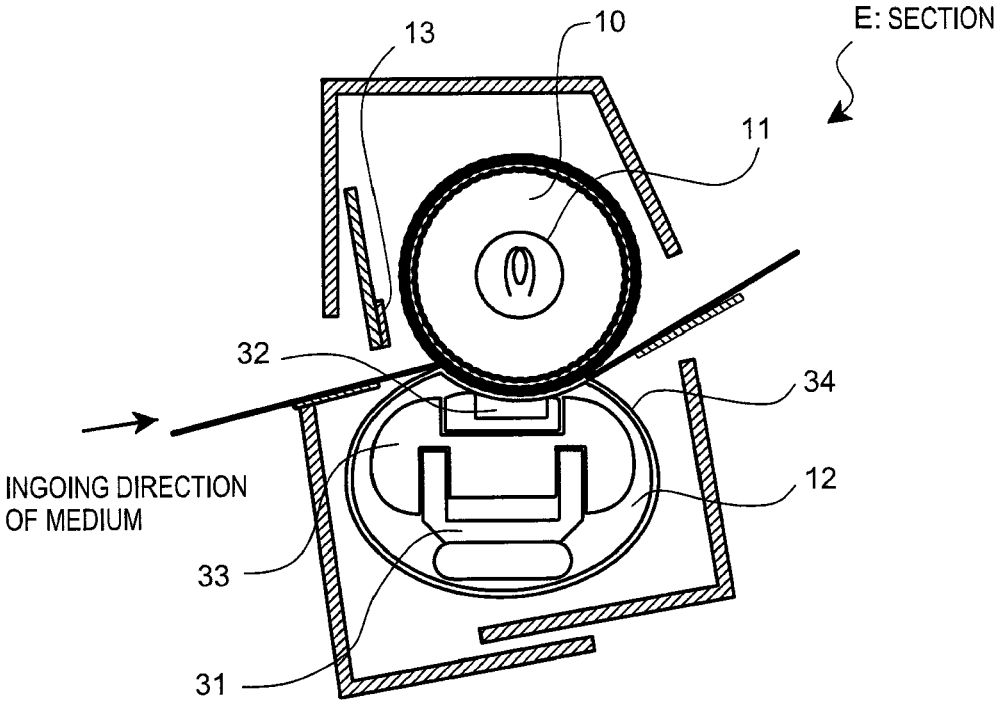
FIG. 2 is a diagram showing a main structure of the fixing section.

After the image forming section transfers different color developing images to paper 14, it conveys the paper to fixing section E along a direction of an arrow h as shown by FIG. 1. Fixing section E, as shown by FIG. 2, includes fixing roller 10 serving as the fixing member that is driven by fixing section (not shown) with a fixing motor, non-joint pressing belt 12 serving as the pressurizing member that is connected with fixing roller 10 and co-rotates with it.

Fixing roller 10 is an iron or aluminum cored bar covered by elastic material such as silicone gum. The surface of the elastic material is covered by fluorine resin that can prevent the developer from sticking. Moreover, a heater 11 is placed inside of the cored bar such as halogen lamp. Pressing belt 12 is covered by non-joint polyimide belt 34 that is formed by sheet 31, silicone gum 32, resin 33 and so on. Pressing belt 12 and fixing roller 10 are on contact and form the NIP portion. During the specification described below, the physical volume of the NIP portion, that is the contact surface between the pressing belt 12 serving as the pressing member and fixing roller 10 serving as the fixing member, is described as NIP volume (mm) and contacted time of NIP portion contacts with a paper when the paper is conveyed, is described as NIP time (ms).

In addition, there is fixing thermistor 13 near fixing roller 10 that is not in contact with it. Fixing thermistor 13 detects the surface temperature of fixing roller 10 and sends it to the temperature controlling section (not shown). Based on the surface temperature of fixing roller 10, the temperature controlling section switches on or off heater 11 (halogen lamp), therefore maintain the surface temperature of fixing roller 10 in a predetermined range. The developer gets to paper 14 on the NIP portion is melted by the heat of fixing roller 10 and is fixed on paper 14.

Next, it is to explain the image forming process of printer 100. First, after the interface (not shown) receives the signal to implement the printing job, the main controlling section (not shown) sends a heating instruction for heater 11 to the temperature controlling section. Then the temperature controlling section switches on heater 11 and it starts to produce heat. In addition, the main controlling section sends a rotation instruction for fixing roller 10 to the fixing section and fixing roller 10 starts to rotate. As fixing roller 10 rotates, pressing belt 12 also begins to rotate.

After thermistor 13 detects that the surface temperature of fixing roller 10 has reached a predetermined point, it sends the signal to the main controlling section the temperature controlling section maintains the temperature by using heater 11. Then the main controlling section give an instruction to the paper feeding mechanism section (not shown) to provide paper 14. The paper feeding mechanism section rotates paper feeding rollers 15*a* and 15*b*, therefore, takes out paper 14 one by one from paper feeding mechanism cassette 22 and conveys it along a direction of an arrow I as shown by FIG. 1.

Further, the paper guide (not shown) conveys paper 14 along a direction of an arrow e as shown by FIG. 1 while conveying rollers 15*c*, 15*d*, 15*e* and 15*f* correct the obliquity of the paper. Idle belt roller 18*a* conveys paper 14 to rotating transfer belt 16 along a direction of an arrow f as shown by FIG. 1.

When conveying rollers 15*c*, 15*d*, 15*e* and 15*f* convey paper 14 along a direction of an arrow e as shown by FIG. 1 and correct the obliquity of it, the development programme based on the image forming section also starts to run. As stated above, the structures of image forming units A~D are exactly the same, here it is only to explain the image forming process of image forming unit A.

When paper 14 is conveyed along a direction of an arrow e as shown by FIG. 1, photosensitive drum 20A starts to rotate at a predetermined peripheral speed. At this time, the charge roller (not shown) in contact with photosensitive drums 20A attaches a unified DC voltage to the surface of photosensitive drum 20A by using charge roller high voltage supply (not shown). Furthermore, the exposure apparatus coupled with photosensitive drum 20A irradiates the surface of photosensitive drum 20A based on the received image signal. The electric potential of the irradiated part is optical attenuated thereby forms an electrostatic latent image.

The developer roller (not shown) provides developer to the electrostatic latent image formed on the surface of photosensitive drum 20A, therefore, forms a developing image. High voltage transfer roller 17*a* (not shown) transfers the developing image to paper 14 and then conveys it along a direction of an arrow f as shown by FIG. 1. On the route, image forming units B, C, D and transfer rollers 17*b*, 17*c*, 17*d* carry out the same developing process successively and transfer the developing images to paper 14. Paper 14 transferred with different color developing images is conveyed along a direction of an arrow h as shown by FIG. 1.

Paper 14 transferred with different color developing images is conveyed to fixing section E that comprises fixing roller 10 and pressing belt 12 along a direction of an arrow h as shown by FIG. 1. Then paper 14 enters the intervals between rotating fixing roller 10 and pressing belt 12 that maintains a predetermined surface temperature. Here, the heat on fixing roller 10 melts the developer on paper 14; the NIP portion between fixing roller 10 and pressing belt 12 presses the melted developer on paper 14 and fixes the developing image onto paper 14.

Further, conveying rollers 15*g*, 15*h*, 15*i* and 15*j* convey paper 14 fixed with developing image to the exterior of printer 100 along a direction of an arrow k as shown by FIG. 1.

In addition, when printer 100 implements a double-side printing job on paper 14, conveying rollers 15*k*, 15*l*, 15*w*, 15*x* convey paper 14 fixed with developing image along a direction of an arrow m as shown by FIG. 1; conveying rollers 15*w*, 15*x* reverse paper 14 and convey it along a direction of an arrow n as shown by FIG. 1; conveying rollers 15*m*~15*v* convey paper 14 along directions of arrows o, p, q as shown by FIG. 1; conveying rollers 15*c*, 15*d* convey paper 14 along a direction of an arrow e as shown by FIG. 1 and implement image forming process on the other side of the paper.

Next, it is to explain the developer. The developer is accommodated in image forming units A~D in printer 100 separated by color. In addition, in the developer of the present invention, it is necessary to add additives such as inorganic powder to the developer particles in the binder serving as binder. The developer particles include crystalline resin and amorphous resin. There is no specific limitation for crystalline resin and amorphous resin. Substances like crystalline polyester resin and amorphous polyester resin are all acceptable. Here, crystalline polyester resin refers to polyester resin with atoms and molecules arranged regularly; amorphous polyester resin refers to polyester resin with atoms and molecules arranged irregularly. Moreover, binder includes addictives such as releasing agents and colorants. It may also be appropriate to add reinforcing fillers such as electric charge controlling agents, conductivity adjustment agents, physical pigment and fibrous material, addictives such as anti-oxidants, anti-aging agents, mobility reinforcing agents, cleaning reinforcing agents.

There is no specific limitation for releasing agents. Aliphatic hydrocarbon wax such as low-molecular polyethylene, low-molecular polypropylene, olefin polymers, micro crystalline wax, paraffin wax and Fischer Tropsch wax, oxidized aliphatic hydrocarbon wax or its block polymer such as oxidized polyethylene wax, entirely or partially oxidized aliphatic ester such as carnauba wax and montan ester wax are all acceptable. It may also use saturated straight-chain aliphatic acid such as palmitic acid, stearin acid, montan acid and alkyl carbon acid with longer-chain alkyl, unsaturated aliphatic acid such as Brassidic acid, eleostearic acid and Parinaric acid, saturated alcohol such as stearyl alcohol, aralkyl alcohol, behenyl alcohol, carnaubyl alcohol, seryl alcohol, melissyl alcohol and alkyl alcohol with longer-chain alkyl, multivalent alcohol such as sorbitol, aliphatic amide such as linoleic amide, oleic amide and lauric amide, bis amide such as methylene bis stearic acid amide, ethylene bis capramide, ethylene bis lauric amide and hexa mechiren bis stearic acid amide, unsaturated aliphatic acid amide such as ethylene bis oleic amide, hexa mechiren bis oleic amide, N,N'-dioleoyl adipic amide and N,N'-dioleoyl sebacic acid, aromatic bis amide such as m-xylene bis stearic acid amide and N,N'-distearic isophthalic acid amide, aliphatic hydrocarbon wax grafted by vinyl monomer such as styrene or acrylic acid, ester of aliphatic acid or multivalent alcohol such as behenic acid monoglyceride, methyl ester with hydroxy group formed by adding vegetable greases into hydrogen.

There is no specific limitation for colorants. Dyes and pigments using black, yellow, magenta and cyan toner colorants are all acceptable. It may use carbon black, phthalocyanine blue, permanent brown FG, brilliant fast scarlet, pigment green B, rhodamine B, solvent red 49, solvent red 146, pigment green 15:3, pigment green 35, quinacridone, carmine 6B, disazo yellow and so on.

It may use salicyl acid complex to serve as electric charge controlling agents.

The effect of external addictives is to improve the environmental stability, charging stability, image forming ability, mobility and preservation ability. It may use inorganic powder such as silica powder.

Next, it is to explain the manufacturing methods of developer.

The raw materials of the developer is 90 units amorphous resin serving as binder, 10 units crystalline polyester resin a severing as crystalline resin, 0.2 units salicyl acid complex (BONTRON E-84, manufactured by Orient Chemical Industries, Ltd.) serving as electric charge controlling agents, 4.0 units MOGUL-L (manufactured by KYABOTTO Co., Ltd) serving as colorants, 3.0 units carnauba wax (carnauba wax powder No. 1, manufactured by S. Kato & Co.) serving as releasing agents.

Further, the raw materials above is mixed by Henschel Mixer (manufactured by MITSUI MINING&SMELTING CO., LTD); milled by biaxial extruder at 100° C.; cut by cutting mill with a 2 mm diameter screen; crushed by conflictive pulverizer "dispersion separator" (manufactured by Nippon Pneumatic Mfg. Co., Ltd.) and classified by air classifier. Finally, it gets developer with particles of an average diameter of 6 um. Moreover, as an adding process, 2.5 units hydrophobic silicon R972 (manufactured by AEROSIL Fumed Silica with particles of an average diameter of 16 nm) and 2.0 units hydrophobic silicon RY-50 (manufactured by AEROSIL Fumed Silica with particles of an average diameter of 40 nm) are crushed (cohesive inorganic particles are separated by high-speed mixing machine such as Henschel Mixer) and mixed with 100 units developer. The mixture is put in a 10-liter Henschel Mixer and stirred for 2 minutes at the speed of 3200 (r/min). Finally, it gets developer A. Furthermore, crystalline polyester resin b, c, d, e, f that have different average molecular weight are used in place of crystalline polyester resin a to produce developer B, C, D, E, F through the same manufacturing methods stated above.

Next, it is to explain the experiment (evaluation) methods of developer.

<Measurement of Endothermic Peak>

Figure 3:
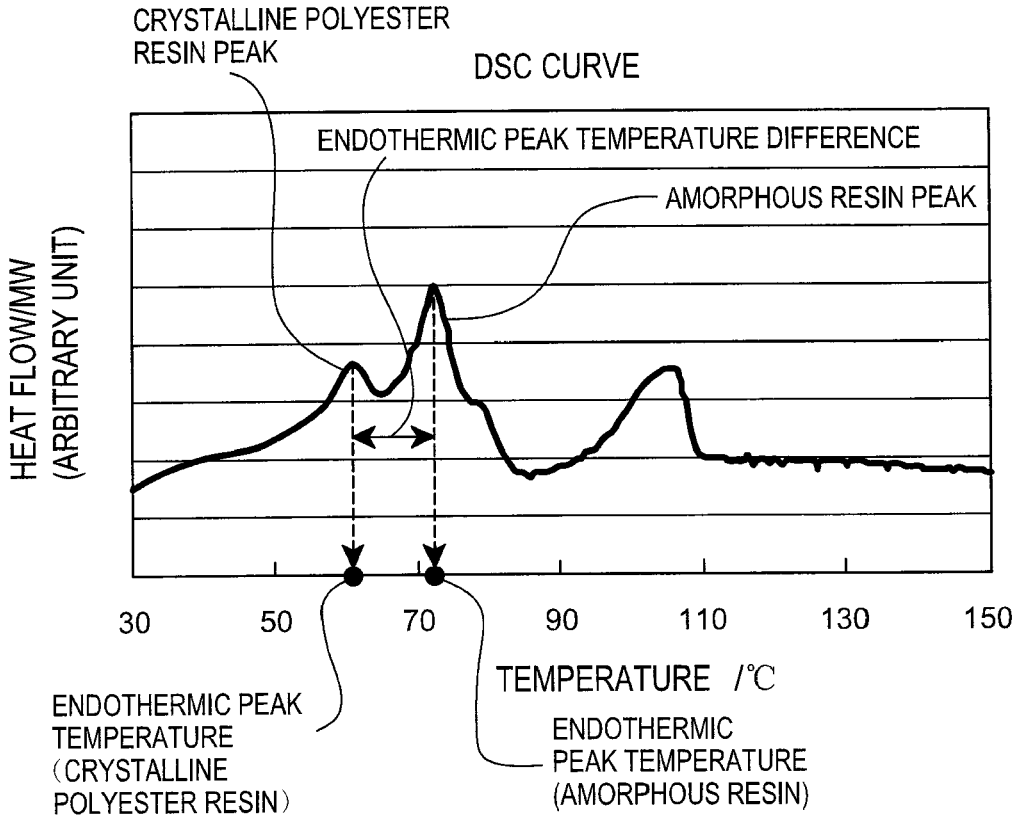
FIG. 3 is a diagram showing an example of DSC Curve in first temperature rising process.

Differential scanning calorimeter ((DSC7, manufactured by PerkinElmer) hereinafter referred to as DSC) are used to measure the endothermic peak of developers. The temperature of developers rises from 30° C. to 150° C. (1st temperature rising process) under the conditions of a temperature rising speed of 10° C./min and the relationship between the temperature and the heat value is found out by DSC. Further, the temperature of developers falls to 30° C. under the conditions of a temperature falling speed of 10° C./min and rises to 150° C. again (2nd temperature rising process) under the conditions of a heating speed of 10° C. 1 min. The DSC measurement result of the 1st temperature rising process is shown as an example of DSC curve in FIG. 1. Endothermic peak above refers to the glass transition temperature at the apex of the endothermic peak. As shown in FIG. 3, when there are several peaks, the peak adopted in the example refers to the lowest temperature peak of crystalline polyester resin and second lowest temperature peak of amorphous resin in the range of 55° C. and 80° C. In the embodiment, it is difficult to ensure good preservation ability of the resin when the endothermic peak of crystalline resin and amorphous resin is under 55° C.; while it is difficult to ensure good fixing ability when the endothermic peak is over 80° C. In addition, fixing section E uses the same DSC measurement results showing in the experiment (measuring the temperature of the developers from the powder state to the molten state during 1st temperature rising process).

<Fixation Ability Evaluation and Fixation Strength Evaluation>

Printer 100 with different NIP volume and different peripheral speed of fixing roller 10 and pressing belt 12 is used to implement the fixation ability evaluation and fixation strength evaluation. These two kinds of evaluation methods are used in the experiment because they show the opposite results in accordance with different developers, but not because they have related characteristics. In addition, in the evaluation, Xerox J-type A4 paper is used and the surface temperature of fixing roller 10 is set from 145° C. to 195° C. As a comparison example, developer 1 and developer 2 are used, both without crystalline polyester resin. Developer 1 uses polyester resin with a high portion of aliphatic monomer to possess good fixation ability under the low-temperature conditions (low-temperature fixing characteristic). Developer 2 uses polyester resin with a high portion of aromatic monomer to possess good preservation ability. Other raw materials and manufacturing methods in developer 1 and developer 2 are the same as the ones used to produce developers A~F.

It is to explain the fixation ability evaluation, further the fixation strength evaluation.

<Fixation Ability Evaluation>

Figure 4:
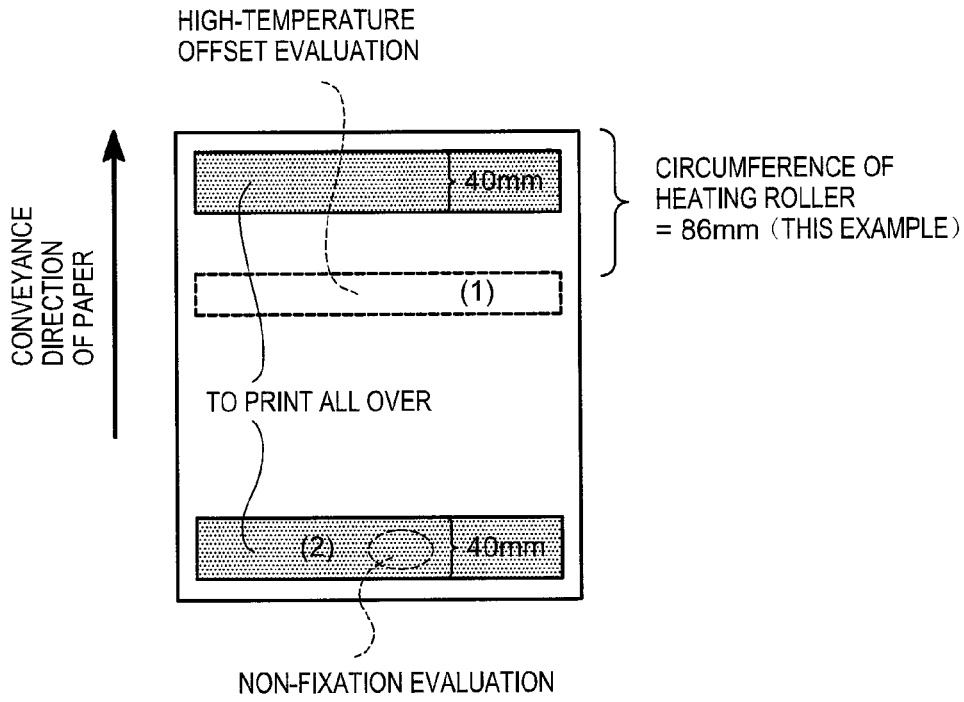
FIG. 4 is a diagram showing evaluation methods.

First of all, as shown in FIG. 4, a printing pattern with a height of 40 mm and a width that can be entirely printed is developed and fixed on the top and bottom of paper 14 with toner adheres to all over (100%) from the printing direction. At this time, if the developer has been giving excessive heat value, it will attach to fixing roller 10. The rotating fixing roller 10 then attaches the developer to paper 14, and this is the so-called high-temperature offset phenomenon. If there is developer leaving on paper 14 at 86 mm position from the top (Position (1) in FIG. 4), the fixation ability evaluation is regarded as high-temperature offset (X). Otherwise, if the developer has not been giving enough heat value, it will be stripped from the paper. The tape (mending tape, manufactured by Sumitomo 3M Ltd.) is stuck to the printing section at the bottom and central part (Position (2) in FIG. 4) of paper 14 from the printing direction and 500 g of weight is moved back and forth for one time to implement the non-fixation evaluation. At the moment, no outside force is exerted on the top of the weight and the speed of the weight is 10 mm/sec. Then X-Rite spectrophotometer (manufactured by X-Rite, Incorporated) is used to measure the concentration of the stripped part and the unstripped part of the tape. If the concentration difference is over 10%, that is, the fixation part is under 90%, the fixation ability evaluation is regarded as unfixed (X).

<Fixation Strength Evaluation>

Figure 5:
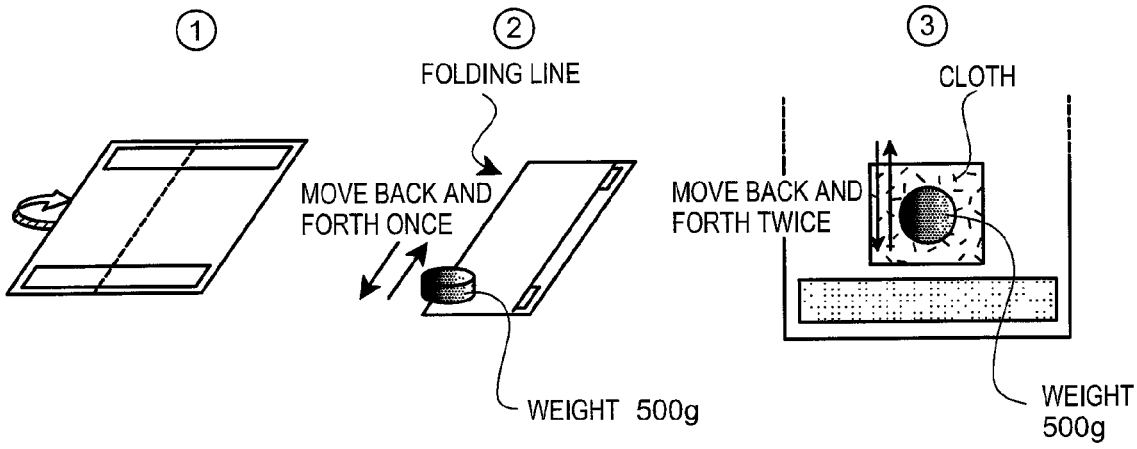
FIG. 5 is a diagram showing evaluation methods.

Fixation strength evaluation measures the strength between the fixed paper and the developer. First, a printing pattern as shown in FIG. 4 above with toner adheres to all over (300%) printed thrice by toner adheres to all over (100%) is developed and fixed on paper 14. Then, as shown in FIG. 5, the blank side of the paper is folded gently. No extra power is exerted and the folding line is untouched. 500 g of weight is moved back and forth for one time on the folding line. At the moment, no outside force is exerted on the top of the weight and the speed of the weight is 10 mm/sec. Further, paper 14 is unfolded and weight is put on the cloth (BEMCOT, manufactured by ASAHI KASEI FIBERS CORPORATION) above the paper. No outside force is exerted on the top of the weight and the speed of the weight is 10 mm/sec. Then the developer is stripped from paper 14. If the width of the stripped position is over 2 mm, the fixation strength is regarded as weak (X); if the width of the stripped position is under 2 mm, the fixation strength is regarded as strong (○)

<Preservation Ability Test>

Figure 6:
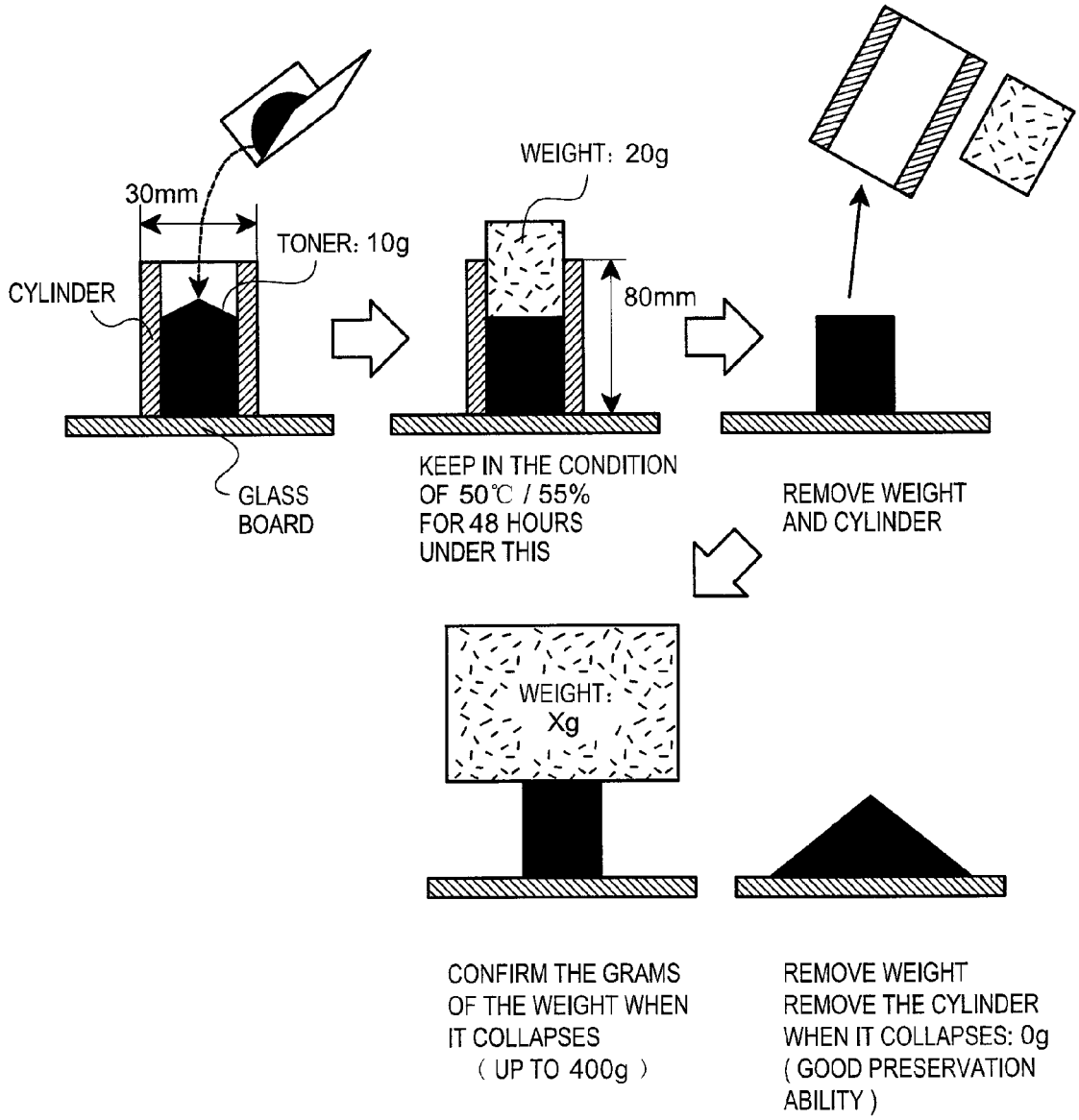
FIG. 6 is a diagram showing evaluation methods.

As shown in FIG. 6, a metal cylinder with a diameter of 30 mm and a height of 80 mm is set. 10 g developer is put into the cylinder and 20 g of weight is placed onto it. After the cylinder has been kept under the conditions of 50° C./55%(temperature/humidity) for 48 hours, the weight and the cylinder are removed slowly. Weight is placed on the developer, 10 g at a time and the grams of the weight is confirmed when it collapses. If the weight is under 30 g when it collapses, the preservation ability of the developer is good (○); If the weight is over 30 g, the preservation ability of the developer is bad (X).

Printer 100 with different NIP volume and different peripheral speed of fixing roller 10 and pressing belt 12 is used to implement the fixation ability evaluation and fixation strength evaluation on developers A~F and developers 1&2 with no crystalline polyester resin. The results are shown in Tables 1~4. Table 1 shows the test results when the NIP volume of fixing section E is 8.0 mm. Similarly, Table 2 shows the results when the NIP volume is 9.1 mm; Table 3 shows the results when the NIP volume is 10.5 mm; Table 4 shows the results when the NIP volume is 11.8 mm. Moreover, the results of the preservation ability tests of developers A~F and developers 1&2 are shown in Table 5. The tables also show the endothermic peak temperature of crystalline polyester resin added in the developers and the endothermic peak temperature difference between crystalline polyester resin and amorphous resin measured by DSC. In addition, the endothermic peak temperature of amorphous resin that used in all the developers are not shown in the tables. As stated above, the endothermic peak temperature of amorphous resin appears in the range of 55° C. and 80° C. The temperature is 72° C.

In "Fixation strength evaluation" column in Tables 1~4, "-" (means unrated) is given when "Fixation ability evaluation" in this row is failed (X). In "Fixation ability evaluation" column, (○) is given in "Integrated" only when the fixation ability evaluation at "145° C." and "195° C." are both good (○). If the result in "145° C." or "195° C." is failed (X), (X) is given in "Integrated". The same rules go for the "Integrated" in "Fixation strength evaluation" column. In "Integrated evaluation" column, "◎" is given when "Fixation ability evaluation" and "Fixation strength evaluation" in this row are both good (○); (○) is given when "Fixation ability evaluation" is good (○) and "Fixation strength evaluation" is failed (X); (X) is given when "Fixation ability evaluation" and "Fixation strength evaluation" are both failed (X).

In addition, the marks and abbreviations used in the tables are shown as follows:

TP=endothermic peak temperature of crystalline polyester resin (° C.)

Endothermic peak temperature difference=the endothermic peak temperature difference between crystalline polyester resin and amorphous resin (° C.)

VF=peripheral speed of fixing roller 10 and pressing belt 12 (conveyance speed of the paper: mm/sec)

Tnip=NIP time (ms) when fixing, defined by NIP volume/VF.

TABLE 1

NIP volume = 8.0 mm

| Developer | $T_P$ (° C.) | Endothermic peak temperature difference (° C.) | $V_F$ (mm/sec) | Tnip (ms) | Fixation ability evaluation 145° C. | Fixation ability evaluation 195° C. | Fixation ability evaluation Integrated | Fixation strength evaluation 145° C. | Fixation strength evaluation 195° C. | Fixation strength evaluation Integrated | Integrated evaluation |
|---|---|---|---|---|---|---|---|---|---|---|---|
| Developer A | 71 | 1 | 73 | 110 | x | x | x | — | — | x | x |
| | | | 106 | 76 | x | x | x | — | — | x | x |
| | | | 138 | 58 | x | x | x | — | — | x | x |
| | | | 171 | 47 | x | x | x | — | — | x | x |
| Developer B | 69 | 3 | 73 | 110 | ○ | x | x | ○ | — | x | x |
| | | | 106 | 76 | ○ | ○ | ○ | ○ | x | x | ○ |
| | | | 138 | 58 | ○ | ○ | ○ | x | ○ | x | ○ |
| | | | 171 | 47 | x | x | x | — | — | x | x |

TABLE 1-continued

NIP volume = 8.0 mm

| Developer | $T_P$ (° C.) | Endo-thermic peak temperature difference (° C.) | $V_F$ (mm/sec) | Tnip (ms) | Fixation ability evaluation 145° C. | 195° C. | Integrated | Fixation strength evaluation 145° C. | 195° C. | Integrated | Integrated evaluation |
|---|---|---|---|---|---|---|---|---|---|---|---|
| Developer C | 67 | 5 | 73 | 110 | ○ | x | x | ○ | — | x | x |
| | | | 106 | 76 | ○ | ○ | ○ | ○ | ○ | ○ | ◎ |
| | | | 138 | 58 | ○ | ○ | ○ | ○ | ○ | ○ | ◎ |
| | | | 171 | 47 | x | ○ | x | — | ○ | x | x |
| Developer D | 65 | 7 | 73 | 110 | ○ | x | x | ○ | — | x | x |
| | | | 106 | 76 | ○ | ○ | ○ | ○ | ○ | ○ | ◎ |
| | | | 138 | 58 | ○ | ○ | ○ | ○ | ○ | ○ | ◎ |
| | | | 171 | 47 | ○ | x | x | x | — | x | x |
| Developer E | 63 | 9 | 73 | 110 | ○ | x | x | ○ | — | x | x |
| | | | 106 | 76 | ○ | ○ | ○ | ○ | ○ | ○ | ◎ |
| | | | 138 | 58 | ○ | ○ | ○ | ○ | ○ | ○ | ◎ |
| | | | 171 | 47 | ○ | x | x | ○ | — | x | x |
| Developer F | 61 | 11 | 73 | 110 | ○ | x | x | ○ | — | x | x |
| | | | 106 | 76 | ○ | x | x | ○ | — | x | x |
| | | | 138 | 58 | ○ | x | x | ○ | — | x | x |
| | | | 171 | 47 | ○ | x | x | ○ | — | x | x |
| Developer 1 | — | — | 73 | 110 | ○ | x | x | ○ | — | x | x |
| | | | 106 | 76 | ○ | x | x | ○ | — | x | x |
| | | | 138 | 58 | ○ | ○ | ○ | x | ○ | x | ○ |
| | | | 171 | 47 | x | ○ | x | — | ○ | x | x |
| Developer 2 | — | — | 73 | 110 | ○ | x | x | ○ | — | x | x |
| | | | 106 | 76 | ○ | x | x | ○ | — | x | x |
| | | | 138 | 58 | x | ○ | x | — | ○ | x | x |
| | | | 171 | 47 | x | ○ | x | — | ○ | x | X |

TABLE 2

NIP volume = 9.1 mm

| Developer | $T_P$ (° C.) | Endo-thermic peak temperature difference (° C.) | $V_F$ (mm/sec) | Tnip (ms) | Fixation ability evaluation 145° C. | 195° C. | Integrated | Fixation strength evaluation 145° C. | 195° C. | Integrated | Integrated evaluation |
|---|---|---|---|---|---|---|---|---|---|---|---|
| Developer A | 71 | 1 | 73 | 125 | x | x | x | — | — | x | x |
| | | | 106 | 86 | x | x | x | — | — | x | x |
| | | | 138 | 66 | x | x | x | — | — | x | x |
| | | | 171 | 53 | x | x | x | — | — | x | x |
| Developer B | 69 | 3 | 73 | 125 | ○ | x | x | ○ | — | x | x |
| | | | 106 | 86 | ○ | ○ | ○ | ○ | x | x | ○ |
| | | | 138 | 66 | ○ | ○ | ○ | ○ | ○ | ○ | ◎ |
| | | | 171 | 53 | ○ | ○ | ○ | x | ○ | x | ○ |
| Developer C | 67 | 5 | 73 | 125 | ○ | x | x | ○ | — | x | x |
| | | | 106 | 86 | ○ | ○ | ○ | ○ | ○ | ○ | ◎ |
| | | | 138 | 66 | ○ | ○ | ○ | ○ | ○ | ○ | ◎ |
| | | | 171 | 53 | ○ | ○ | ○ | ○ | ○ | ○ | ◎ |
| Developer D | 65 | 7 | 73 | 125 | ○ | x | x | ○ | — | x | x |
| | | | 106 | 86 | ○ | ○ | ○ | ○ | ○ | ○ | ◎ |
| | | | 138 | 66 | ○ | ○ | ○ | ○ | ○ | ○ | ◎ |
| | | | 171 | 53 | ○ | ○ | ○ | ○ | ○ | ○ | ◎ |
| Developer E | 63 | 9 | 73 | 125 | ○ | x | x | ○ | — | x | x |
| | | | 106 | 86 | ○ | ○ | ○ | ○ | ○ | ○ | ◎ |
| | | | 138 | 66 | ○ | ○ | ○ | ○ | ○ | ○ | ◎ |
| | | | 171 | 53 | ○ | ○ | ○ | ○ | ○ | ○ | ◎ |
| Developer F | 61 | 11 | 73 | 125 | ○ | x | x | ○ | — | x | x |
| | | | 106 | 86 | ○ | x | x | ○ | — | x | x |
| | | | 138 | 66 | ○ | x | x | ○ | — | x | x |
| | | | 171 | 53 | ○ | x | x | ○ | — | x | x |
| Developer 1 | — | — | 73 | 125 | ○ | x | x | ○ | — | x | x |
| | | | 106 | 86 | ○ | x | x | ○ | — | x | x |
| | | | 138 | 66 | ○ | ○ | ○ | ○ | ○ | ○ | ◎ |
| | | | 171 | 53 | x | ○ | x | — | ○ | x | x |

TABLE 2-continued

| NIP volume = 9.1 mm | | | | | | | | | | | |
|---|---|---|---|---|---|---|---|---|---|---|---|
| | $T_P$ | Endo-thermic peak temperature difference | $V_F$ | Tnip | Fixation ability evaluation | | | Fixation strength evaluation | | | Integrated |
| Developer | (° C.) | (° C.) | (mm/sec) | (ms) | 145° C. | 195° C. | Integrated | 145° C. | 195° C. | Integrated | evaluation |
| Developer 2 | — | — | 73 | 125 | ○ | x | x | ○ | — | x | x |
| | | | 106 | 86 | ○ | x | x | ○ | — | x | x |
| | | | 138 | 66 | x | ○ | x | — | ○ | x | x |
| | | | 171 | 53 | x | ○ | x | — | ○ | x | X |

TABLE 3

| NIP Volume = 10.5 mm | | | | | | | | | | | |
|---|---|---|---|---|---|---|---|---|---|---|---|
| | $T_P$ | Endo-thermic peak temperature difference | $V_F$ | Tnip | Fixation ability evaluation | | | Fixation strength evaluation | | | Integrated |
| Developer | (° C.) | (° C.) | (mm/sec) | (ms) | 145° C. | 195° C. | Integrated | 145° C. | 195° C. | Integrated | evaluation |
| Developer A | 71 | 1 | 73 | 144 | x | x | x | — | — | x | x |
| | | | 106 | 99 | x | x | x | — | — | x | x |
| | | | 138 | 76 | x | x | x | — | — | x | x |
| | | | 171 | 61 | x | x | x | — | — | x | x |
| Developer B | 69 | 3 | 73 | 144 | ○ | x | x | ○ | — | x | x |
| | | | 106 | 99 | ○ | x | x | ○ | — | x | x |
| | | | 138 | 76 | ○ | ○ | ○ | ○ | x | x | ○ |
| | | | 171 | 61 | ○ | ○ | ○ | ○ | ○ | ○ | ◎ |
| Developer C | 67 | 5 | 73 | 144 | ○ | x | x | ○ | — | x | x |
| | | | 106 | 99 | ○ | x | x | ○ | — | x | x |
| | | | 138 | 76 | ○ | ○ | ○ | ○ | ○ | ○ | ◎ |
| | | | 171 | 61 | ○ | ○ | ○ | ○ | ○ | ○ | ◎ |
| Developer D | 65 | 7 | 73 | 144 | ○ | x | x | ○ | — | x | x |
| | | | 106 | 99 | ○ | x | x | ○ | — | x | x |
| | | | 138 | 76 | ○ | ○ | ○ | ○ | ○ | ○ | ◎ |
| | | | 171 | 61 | ○ | ○ | ○ | ○ | ○ | ○ | ◎ |
| Developer E | 63 | 9 | 73 | 144 | ○ | x | x | ○ | — | x | x |
| | | | 106 | 99 | ○ | x | x | ○ | — | x | x |
| | | | 138 | 76 | ○ | ○ | ○ | ○ | ○ | ○ | ◎ |
| | | | 171 | 61 | ○ | ○ | ○ | ○ | ○ | ○ | ◎ |
| Developer F | 61 | 11 | 73 | 144 | ○ | x | x | ○ | — | x | x |
| | | | 106 | 99 | ○ | x | x | ○ | — | x | x |
| | | | 138 | 76 | ○ | x | x | ○ | — | x | x |
| | | | 171 | 61 | ○ | x | x | ○ | — | x | x |
| Developer 1 | — | — | 73 | 144 | ○ | x | x | ○ | — | x | x |
| | | | 106 | 99 | ○ | x | x | ○ | — | x | x |
| | | | 138 | 76 | ○ | x | x | ○ | — | x | x |
| | | | 171 | 61 | ○ | ○ | ○ | ○ | ○ | ○ | ◎ |
| Developer 2 | — | — | 73 | 144 | ○ | x | x | ○ | — | x | x |
| | | | 106 | 99 | ○ | x | x | ○ | — | x | x |
| | | | 138 | 76 | ○ | x | x | ○ | — | x | x |
| | | | 171 | 61 | x | ○ | x | — | ○ | x | X |

TABLE 4

| NIP Volume = 11.8 mm | | | | | | | | | | | |
|---|---|---|---|---|---|---|---|---|---|---|---|
| | | Endo-thermic peak temperature difference | | | Fixation ability evaluation | | | Fixation strength evaluation | | | Integrated |
| Developer | $T_P$ (° C.) | (° C.) | $V_F$ (mm/sec) | Tnip (ms) | 145° C. | 195° C. | Integrated | 145° C. | 195° C. | Integrated | evaluation |
| Developer A | 71 | 1 | 73 | 162 | x | x | x | — | — | x | x |
| | | | 106 | 111 | x | x | x | — | — | x | x |
| | | | 138 | 86 | x | x | x | — | — | x | x |
| | | | 171 | 69 | x | x | x | — | — | x | x |
| Developer B | 69 | 3 | 73 | 162 | ○ | x | x | ○ | — | x | x |
| | | | 106 | 111 | ○ | x | x | ○ | — | x | x |
| | | | 138 | 86 | ○ | ○ | ○ | ○ | x | x | ○ |
| | | | 171 | 69 | ○ | ○ | ○ | ○ | x | x | ○ |
| Developer C | 67 | 5 | 73 | 162 | ○ | x | x | ○ | — | x | x |
| | | | 106 | 111 | ○ | x | x | ○ | — | x | x |
| | | | 138 | 86 | ○ | ○ | ○ | ○ | ○ | ○ | ◎ |
| | | | 171 | 69 | ○ | ○ | ○ | ○ | ○ | ○ | ◎ |
| Developer D | 65 | 7 | 73 | 162 | ○ | x | x | ○ | — | x | x |
| | | | 106 | 111 | ○ | x | x | ○ | — | x | x |
| | | | 138 | 86 | ○ | ○ | ○ | ○ | ○ | ○ | ◎ |
| | | | 171 | 69 | ○ | ○ | ○ | ○ | ○ | ○ | ◎ |
| Developer E | 63 | 9 | 73 | 162 | ○ | x | x | ○ | — | x | x |
| | | | 106 | 111 | ○ | x | x | ○ | — | x | x |
| | | | 138 | 86 | ○ | ○ | ○ | ○ | ○ | ○ | ◎ |
| | | | 171 | 69 | ○ | ○ | ○ | ○ | ○ | ○ | ◎ |
| Developer F | 61 | 11 | 73 | 162 | ○ | x | x | ○ | — | x | x |
| | | | 106 | 111 | ○ | x | x | ○ | — | x | x |
| | | | 138 | 86 | ○ | x | x | ○ | — | x | x |
| | | | 171 | 69 | ○ | x | x | ○ | — | x | x |
| Developer 1 | — | — | 73 | 162 | ○ | x | x | ○ | — | x | x |
| | | | 106 | 111 | ○ | x | x | ○ | — | x | x |
| | | | 138 | 86 | ○ | x | x | ○ | — | x | x |
| | | | 171 | 69 | ○ | ○ | ○ | ○ | ○ | ○ | ◎ |
| Developer 2 | — | — | 73 | 162 | ○ | x | x | ○ | — | x | x |
| | | | 106 | 111 | ○ | x | x | ○ | — | x | x |
| | | | 138 | 86 | ○ | x | x | ○ | — | x | x |
| | | | 171 | 69 | ○ | ○ | ○ | x | ○ | x | ○ |

TABLE 5

| Developer | $T_P$ (° C.) | Endothermic peak temperature difference (° C.) | Preservation ability test result |
|---|---|---|---|
| Developer A | 71 | 1 | ○ |
| Developer B | 69 | 3 | ○ |
| Developer C | 67 | 5 | ○ |
| Developer D | 65 | 7 | ○ |
| Developer E | 63 | 9 | ○ |
| Developer F | 61 | 11 | ○ |
| Developer 1 | — | — | x |
| Developer 2 | — | — | ○ |

Judged from the results in Tables 1~4, the developer of the present invention including crystalline polyester resin has a large endothermic peak temperature difference and a large Tnip, therefore, is able to be fixed under the low-temperature conditions. The developer has a large endothermic peak temperature difference because the endothermic peak temperature difference of crystalline polyester resin is shifted to the low-temperature side, and a large Tnip because it gets increasing heat value from fixing section E. The result of the fixation strength evaluation is based on the fixation strength evaluation. If the endothermic peak temperature is too large, there will be a difference between the heat absorption capacity of crystalline polyester resin and amorphous polyester resin, therefore, the fixation strength will be deteriorated. In addition, developer 1 possesses good fixation ability under the low-temperature conditions because it includes polyester resin with a high portion of aliphatic monomer; while developer 2 doesn't possess such characteristic because it uses polyester resin with a high portion of aromatic monomer to acquire good preservation ability.

In the preservation ability test, developers including crystalline polyester resin all get good results. This is due to the sharp melting characteristic of crystalline polyester resin. In addition, the preservation ability of developer 1 is bad since it uses polyester resin with a high portion of aliphatic monomer.

Figure 7:
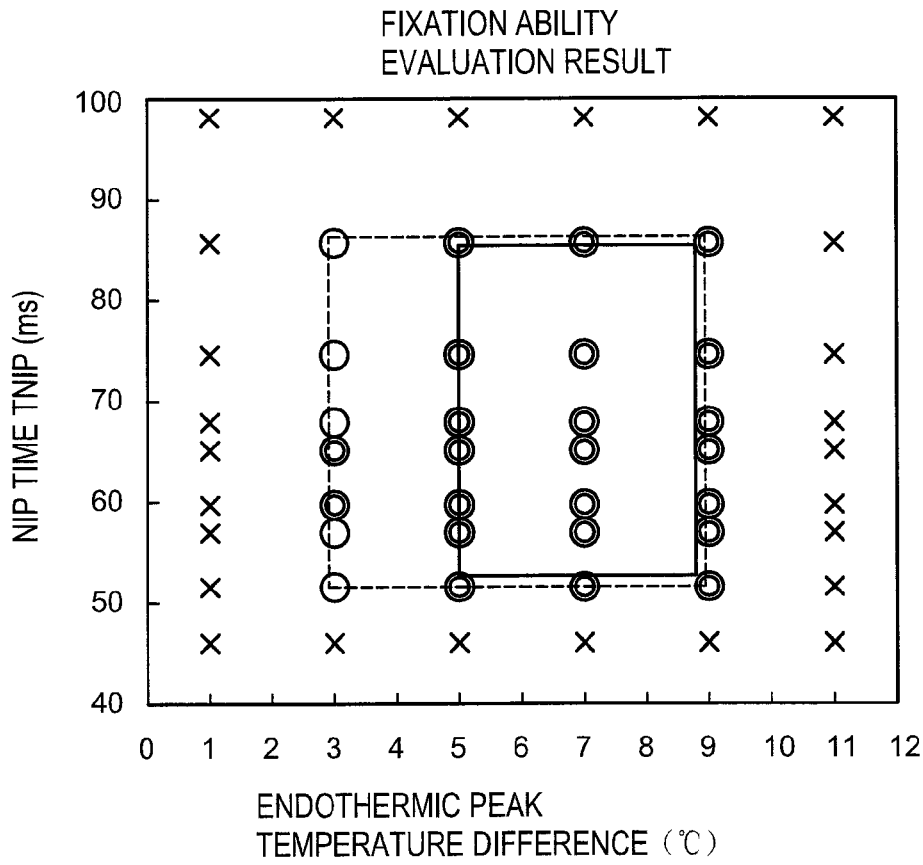
FIG. 7 is a diagram showing results of the fixation ability evaluation.

FIG. 7 is the sum up result of the evaluations above. The X-axis in FIG. 7 is the endothermic peak temperature difference and the Y-axis is the NIP time (Tnip). The results of "Integrated evaluation" in Tables 1~4 are shown as graphs. Here, x means "Fixation ability evaluation" and "Fixation strength evaluation" are both failed; o means "Fixation ability evaluation" is good while "Fixation strength evaluation" is failed; ◎ means "Fixation ability evaluation" and "Fixation strength evaluation" are both good. In FIG. 7, the part enclosed by the dotted lines means the fixation ability is good when the NIP time is from 53 ms to 86 ms and the endothermic peak temperature difference between crystalline polyester resin and amorphous polyester resin is from 3° C. to 9° C. Moreover, the part enclosed by the continuous lines means the fixation ability is excellent when the NIP time is from 53 ms to 86 ms and the endothermic peak temperature difference between crystalline polyester resin and amorphous polyester resin is from 5° C. to 9° C.

Figure 8:
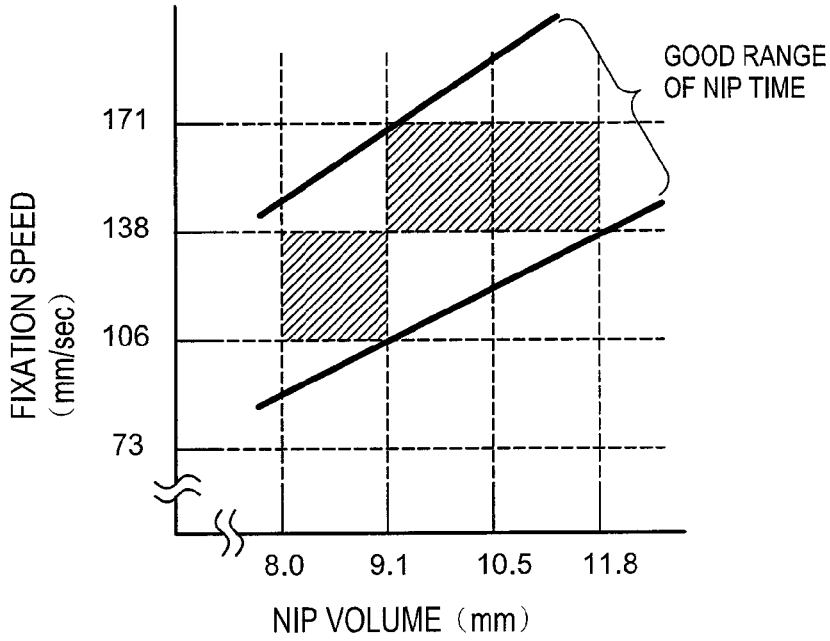
FIG. 8 is a diagram showing results of the fixation ability evaluation.

As shown in FIG. 8, when "Fixation ability evaluation" and "Fixation strength evaluation" are both good, the NIP time is from 53 ms to 86 ms and is shown as the part covered by the oblique lines. The result is acquired under the conditions of the NIP volume from 8.0 mm to 9.1 mm and the peripheral speed of fixing roller 10 and pressing belt from 106 mm/sec to 138 mm/sec, or the NIP volume from 9.1 mm to 11.8 mm and the peripheral speed of fixing roller 10 and pressing belt from 138 mm/sec to 171 mm/sec. In addition, "Good range of NIP time" in FIG. 8 can be obtained from theory or experiment. If the paper is printed above the good range of NIP time, the developer cannot be fully melted because NIP time is too long. If the paper is printed below the good range, the developer will be over-melted and attach to fixing roller 10 as well. This will cause the high-temperature offset. Therefore, in embodiment 1, the part outside "Good range of NIP time" is regarded as failed.

As stated above, the fixation ability of the developer is good under the conditions of the NIP time from 53 ms to 86 ms (when the NIP volume is from 8.0 mm to 9.1 mm and the peripheral speed of fixing roller 10 and pressing belt is from 106 mm/sec to 138 mm/sec, or the NIP volume is from 9.1 mm to 11.8 mm and the peripheral speed of fixing roller 10 and pressing belt is from 138 mm/sec to 171 mm/sec), the endothermic peak temperature difference between crystalline polyester resin and amorphous polyester resin from 3° C. to 9° C. in the temperature range of 55° C.~80° C. and the fixing temperature of fixing section E from 145° C. to 195° C. Moreover, the fixation ability of the developer is excellent under the conditions of the NIP time from 53 ms to 86 ms (when the NIP volume is from 8.0 mm to 9.1 mm and the peripheral speed of fixing roller 10 and pressing belt is from 106 mm/sec to 138 mm/sec, or the NIP volume is from 9.1 mm to 11.8 mm and the peripheral speed of fixing roller 10 and pressing belt is from 138 mm/sec to 171 mm/sec), the endothermic peak temperature difference between crystalline polyester resin and amorphous polyester resin from 5° C. to 9° C. and the fixing temperature of fixing section E from 145° C. to 195° C. In addition, developers A~F of the present invention also show good preservation ability. Therefore, in embodiment 1, it shows an image forming apparatus that can provide a good temperature range under the low-temperature conditions during the fixing process and good preserving condition for the developer.

Embodiment 2

In embodiment 2, the printer uses pressing roller 36 in fixing section E in place of pressing belt 12 in fixing section E in embodiment 1. Therefore the NIP volume of fixing section F is much smaller than the one of fixing section E. In addition, in embodiment 2, other structure of the apparatus except fixing section F and the image forming process are the same as in embodiment 1, so it is omitted hereinafter.

Figure 9:
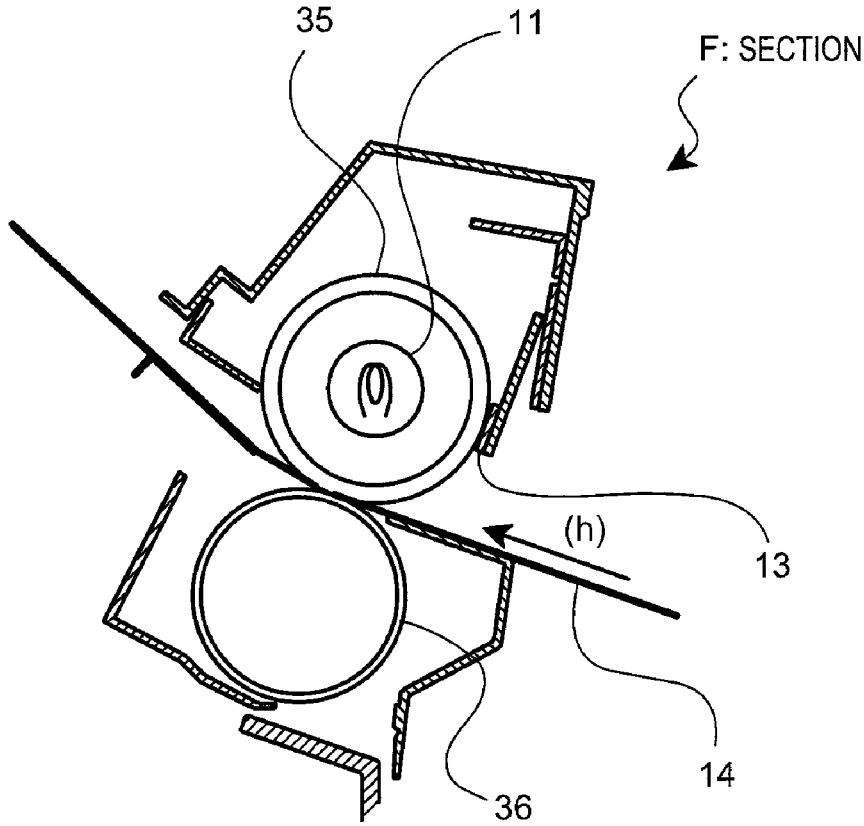
FIG. 9 is a diagram showing a main structure of the fixing section.

Fixing section F, as shown by FIG. 9, includes fixing roller 35 serving as the fixing member that is driven by fixing section (not shown) with a fixing motor, pressing roller 36 serving as the pressurizing member that is connected with fixing roller 35 and co-rotates with it.

Fixing roller 35 is an iron or aluminum cored bar covered by elastic material such as silicone gum. The surface of the elastic material is covered by fluorine resin that can prevent the developer from sticking. Moreover, the cored bar comprises heater 11 such as halogen lamp. Pressing roller 36 is an aluminum cored bar covered by elastic material such as silicone gum and PFA (tetrafluoroethylene-perfluoroethyl vinyl ether copolymer). Pressing roller 36 and fixing roller 35 are on contact and form the NIP portion.

In addition, there is fixing thermistor 13 near fixing roller 35 that is not in contact with it. Fixing thermistor 13 detects the surface temperature of fixing roller 35 and sends it to the temperature controlling section (not shown). Based on the surface temperature of fixing roller 35, the temperature controlling section switches on or off heater 11 (halogen lamp), therefore maintain the surface temperature of fixing roller 10 in a predetermined range. The developer gets to paper 14 on the NIP portion is melted by the heat of fixing roller 35 and is fixed on paper 14.

The curl evaluation on print materials is implemented by using fixing section E in embodiment 1 and fixing section F in embodiment 2 under the environmental conditions and experimental process shown as follows.

Environmental condition: 20° C./30% (temperature/humidity) (hereinafter referred to Condition NN) and 28° C./80% (hereinafter referred to Condition HH)

Developer: Developer C

Fixing section: Fixing section E (NIP volume=11.8 mm) and fixing section F (NIP volume=6.6 mm)

Paper: Lightweight paper (Xerox P paper, 64 g/m$^2$) and official postcard (157 g/m$^2$)

Printing pattern: toner adheres to all over (100%)

Printing speed: 155 mm/sec

Fixing temperature: 175° C.

Figure 10:
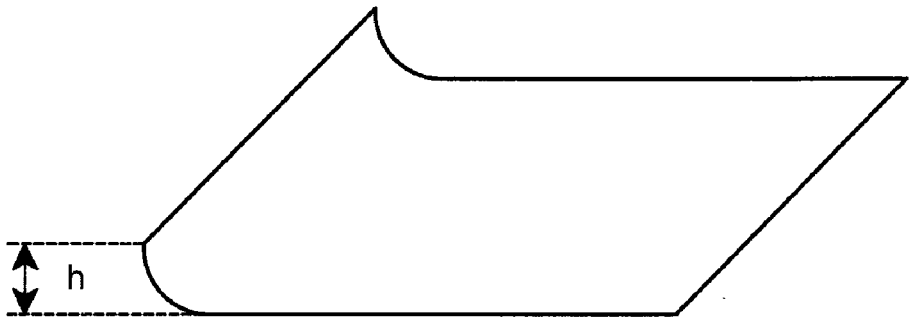
FIG. 10 is a diagram showing evaluation methods.

Experimental process: after the printer with developer, the fixing sections and the paper have been kept for 12 hours, 10 pages of paper on both kinds of the paper with toner adheres to all over (100%) are printed under Condition NN and Condition HH. The paper is kept for five minutes and the curl volume (h) is measured by nonius, as shown in FIG. 10. If the curl volume of lightweight paper is over 30 mm, the print quality is regarded as bad; if the curl volume of official post card is over 10 mm, the print quality is regarded bad.

Table 6 shows the result of the curl evaluation. Judged from the results, non-joint pressing belt 12 serving as the fixing member in fixing section E is prone to print curled paper because the NIP volume is too large and the heating time of the paper is too long. The print quality of the paper is good when fixing roller 36 serving as the fixing member is used.

TABLE 6

| | Condition NN | | Condition HH | |
|---|---|---|---|---|
| | Lightweight paper | Official postcard | Lightweight paper | Official postcard |
| Fixing section F | 0 | 0 | 2 | 1 |
| Fixing section E | 2 | 1 | 5 | 3 |

(Number(s) of Paper with Bad Print Quality)

As stated above, through using fixing roller 36 serving as the fixing member in fixing section F with the NIP volume of 6.6 mm and the printing speed of 155 mm/sec, and developer with the endothermic peak temperature difference between crystalline polyester resin and amorphous polyester resin at 7° C., it is possible to get uncurled paper with good print quality.

The present invention is not limited to the foregoing embodiments but many modifications and variations are possible within the spirit and scope of the appended claims of the invention. The invention can also be applied to devices such as copying machine, FAX machine, MFP (Multi-Functional Peripheral) besides the printer shown in the embodiments.

What is claimed is:

1. An image forming apparatus, comprising:

an image forming section that forms an image onto medium by using developer; and a fixing section that has a fixing member which fixes the image onto medium at a predetermined temperature and has a pressing member which is in contact with and presses the fixing member by a predetermined pressure amount, and that fixes the image formed by the image forming section onto the medium while conveying the medium at a predetermined speed, wherein the developer contains binder including crystalline resin and amorphous resin, and the endothermic peak temperature difference between crystalline resin and amorphous resin is from 3° C. to 9° C.

2. The image forming apparatus according to claim 1, wherein the endothermic peak temperature difference between crystalline resin and amorphous resin is from 5° C. to 9° C.

3. The image forming apparatus according to claim 1, wherein the crystalline resin is crystalline polyester resin.

4. The image forming apparatus according to claim 1, wherein a NIP time of the fixing member is from 53 ms to 86 ms.

5. The image forming apparatus according to claim 1, wherein a heating temperature of the fixing member is from 145° C. to 195° C.

6. The image forming apparatus according to claim 1, wherein when a pressure amount of the pressing member is that enabling a NIP volume to be from 8.0 mm to 9.1 mm, a conveyance speed of the medium is from 106 mm/sec to 138 mm/sec.

7. The image forming apparatus according to claim 1, wherein when a pressure amount of the pressing member is that enabling a NIP volume to be from 9.1 mm to 11.8 mm, a conveyance speed of the medium is from 138 mm/sec to 171 mm/sec.

8. The image forming apparatus according to claim 1, wherein the endothermic peak is a temperature measured by a differential scanning calorimeter during 1st temperature rising process.

9. The image forming apparatus according to claim 1, wherein the endothermic peak temperature of the developer is from 55° C. to 80° C.

10. The image forming apparatus according to claim 1, wherein a pressure amount of the pressing member is that enabling a NIP volume to be about 6.6 mm.

11. The image forming apparatus according to claim 1, wherein the fixing member conveys the medium at a speed of about 155 mm/sec.

12. An image forming apparatus, comprising:

an image forming section that forms image onto medium by using developer; and a fixing section that has a fixing member which fixes the image onto medium at a predetermined temperature and has a pressing member which is in contact with and presses the fixing member by a predetermined amount of pressure, and that fixes the image formed by the image forming section onto the medium while conveying the medium at a predetermined speed, wherein the developer contains two kinds of resin with different endothermic peak temperature when the endothermic peak temperature of the developer is from 55° C. to 80° C.; the endothermic peak temperature difference between the resins is from 3° C. to 9° C.

13. The image forming apparatus according to claim 12, wherein the two kinds of resin are crystalline resin and amorphous resin and the endothermic peak temperature difference between the resins is from 5° C. to 9° C.

14. The image forming apparatus according to claim 12, one kind of the resin is a crystalline resin.

15. The image forming apparatus according to claim 13, wherein the crystalline resin is crystalline polyester resin.

16. The image forming apparatus according to claim 12, wherein a NIP time of the fixing member is from 53 ms to 86 ms.

17. The image forming apparatus according to claim 12, wherein a heating temperature of the fixing member is from 145° C. to 195° C.

* * * * *